United States Patent [19]

Gannaway

[11] 4,370,099

[45] Jan. 25, 1983

[54] DISCHARGE GAS TEMPERATURE CONTROL

[75] Inventor: Edwin L. Gannaway, Adrian, Mich.

[73] Assignee: Tecumseh Products Company, Tecumseh, Mich.

[21] Appl. No.: 851,052

[22] Filed: Nov. 14, 1977

[51] Int. Cl.[3] ..... F04B 49/02

[52] U.S. Cl. ..... 417/32; 417/312; 417/902; 62/228

[58] Field of Search ..... 417/312, 32, 902; 62/228 R

[56] References Cited

U.S. PATENT DOCUMENTS

| | | | |
|---|---|---|---|
| 3,232,519 | 2/1966 | Long | 417/32 X |
| 3,233,822 | 2/1966 | Comstock et al. | 417/32 X |
| 3,278,111 | 10/1966 | Parker | 417/32 |
| 3,531,222 | 9/1970 | Randall et al. | 417/902 X |

*Primary Examiner*—Leonard E. Smith

*Attorney, Agent, or Firm*—Albert L. Jeffers; Roger M. Rickert

[57] ABSTRACT

A discharge gas temperature sensing corrective arrangement for a hermetic motor-compressor unit is disclosed wherein a heat sensitive element is supported in a discharge muffler located remote from the compressor outlet and in good heat transfer relation with compressed gas entering the discharge muffler from the compressor outlet so that the heat sensitive element provides an indication of the temperature of that compressed gas as it enters the discharge muffler. The discharge muffler outlet is connected to a somewhat conventional refrigerating circuit and a conduit connects the discharge muffler inlet to the compressor outlet. The compressor may include a plurality of gas compressing cylinders having their respective discharge ports connected together to form a discharge gas manifold which functions as a muffler within the compressor with the conduit connected to that discharge gas manifold. The hermetic unit may include first and second casing portions which are joinable, for example, by welding about an annular region with the sensor coupling circuitry disposed entirely on one side of the plane of the annular region and sufficiently distant from that region to prevent heat damage to the circuitry during the welding operation. The conduit connecting the compressor outlet to the discharge muffler typically passes through the plane of this annular region.

14 Claims, 3 Drawing Figures

DISCHARGE GAS TEMPERATURE CONTROL

BACKGROUND OF THE INVENTION

The present invention relates generally to compressors and more particularly to protective arrangements for such compressors, especially of the type which disable the compressor drive motor when the temperature of the discharge gas from the compressor exceeds some prescribed value.

Such thermal overload protection systems are known generally and typically comprise a temperature sensitive element to be influenced by the temperature of the region to be protected with the temperature sensitive element being operative to, for example, control an electric circuit or the like which will initiate compensatory action. Such compensatory action in the case of a compressor may consist of turning off the compressor drive motor.

One well-known and commercially available thermal overload protection system comprises a thermal sensing element in contact with the compressor drive motor coils for detecting an overload condition such as a stalled or locked rotor by responding to the overheated motor coil manifestation of the problem and by way of a solid state motor control circuit interrupting the supply of current to the motor.

Another known arrangement for thermal overload protection in a compressor is disclosed in U.S. Pat. No. 3,278,111 issued to Sidney A. Parker on Oct. 11, 1966. The Parker patent locates a thermostatic switch of, for example, the bimetallic element type in the discharge gas manifold of the compressor which manifold forms the connection between the several compressor cylinder outlets and may function as a gas muffling chamber. The Parker arrangement has the thermostatic switch contacts closed so long as the temperature of this discharge gas is below some prescribed value and has those thermostat contacts in series with the compressor drive motor or may employ the state of those contacts for controlling a control relay which in turn supplies or interrupts the current flow to the motor depending upon the relay state. A variation on this arrangement is illustrated in the more recent Parker U.S. Pat. No. 3,877,837.

Rather than locating a temperature sensor in the discharge gas manifold directly adjacent to the compressor, the applicant has in his copending application Ser. No. 670,646, filed Mar. 26, 1976, now U.S. Pat. No. 4,059,366, placed a temperature sensing device in a well, closely adjacent to and downstream from the compressor cylinder discharge valve, thereby obtaining a very accurate indication of the discharge gas temperature emanating from the particular cylinder being monitored. With the arrangement dislosed in the applicant's prior application, it is possible, but not probable, that the gas emanating from an unmonitored cylinder exceeds the prescribed temperature limits, while the gas emanating from the cylinder being monitored does not, and accordingly to be absolutely sure of no excessive discharge gas temperatures, each cylinder could be provided with a temperature sensor. Also with the applicant's prior arrangement the electrical circuitry must pass from the region of the compressor heads to the region of the drive motor, which according to present day fabricating techniques requires that this circuitry pass relatively near an annular region where two halves of the hermetic enclosure or casing are joined, typically by welding. Such welding dramatically raises the temperature in the area of the welded joint, and the electrical connections with the applicant's prior device needed a metallic shielding conduit to prevent heat deterioration of the insulation on the conductors. The positioning of a temperature sensor close to the motor and entirely within one half of the casing will remove the conductors from the weld region, thereby obviating the need for heat protection for those conductors during the assembly welding process.

SUMMARY OF THE INVENTION

Among the several objects of the present invention may be noted the provision of a compressor system having a two stage discharge muffling arrangement with temperature protection associated with the second stage; the provision of a compressor discharge muffler within a hermetic motor compressor unit located remote from the compressor and having a heat sensitive element for providing an indication of the temperature of the compressed gas as it enters the discharge muffler and including circuitry coupled thereto for disabling the motor when the temperature of the compressed gas is sensed as exceeding a maximum desired operating temperature; the provision of a heat sensitive element disposed in a well extending inwardly from the discharge muffler surface with the heat sensitive element being in good heat transfer relation with the discharge gas entering that discharge muffler; the provision of temperature protective circuitry for a hermetic compressor which circuitry due to its location within the compressor is inherently protected from heat damage during compressor assembly; the provision of circuitry for interrupting the operation of a compressor drive motor upon the detection of an excessive exhaust gas temperature characterized by relatively short electrical leads extending from the motor to the temperature sensor location; and the provision of a discharge gas temperature sensing corrective arrangement for a hermetic motor compressor unit characterized by its simplicity, ease and economy of manufacture and assembly, and reliability.

In general, and in one form of the invention, a compressor discharge muffler is disposed within a hermetic unit and remote from the compressor portion thereof, being connected to the compressor by a conduit within the hermetic unit forming a part of the refrigerating circuit. A heat sensitive element is supported in the discharge muffler and in good heat transfer relation with the compressed gas entering the discharge muffler by way of the conduit to provide an indication of the temperature of that compressed gas. Circuitry couples the heat sensitive element in controlling relation to the hermetic unit motor for disabling that motor when the temperature of the compressed gas entering the discharge muffler exceeds a maximum desired operating temperature.

Also in general, and in one form of the invention, a discharge gas muffler is located apart from the compressor with a conduit coupling the compressor discharge gas manifold to the discharge muffler with a heat sensitive element disposed in a well extending inwardly from the discharge muffler surface with the heat sensitive element being in good heat transfer relation with the discharge gas entering the discharge muffler. Circuitry couples the heat sensitive element in controlling relation to the compressor drive motor for interrupting motor operation when the temperature of the heat sensitive element exceeds a predetermined value.

BRIEF DESCRIPTION OF THE DRAWING

Corresponding reference characters indicate corresponding parts throughout the several views of the drawing.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 1:
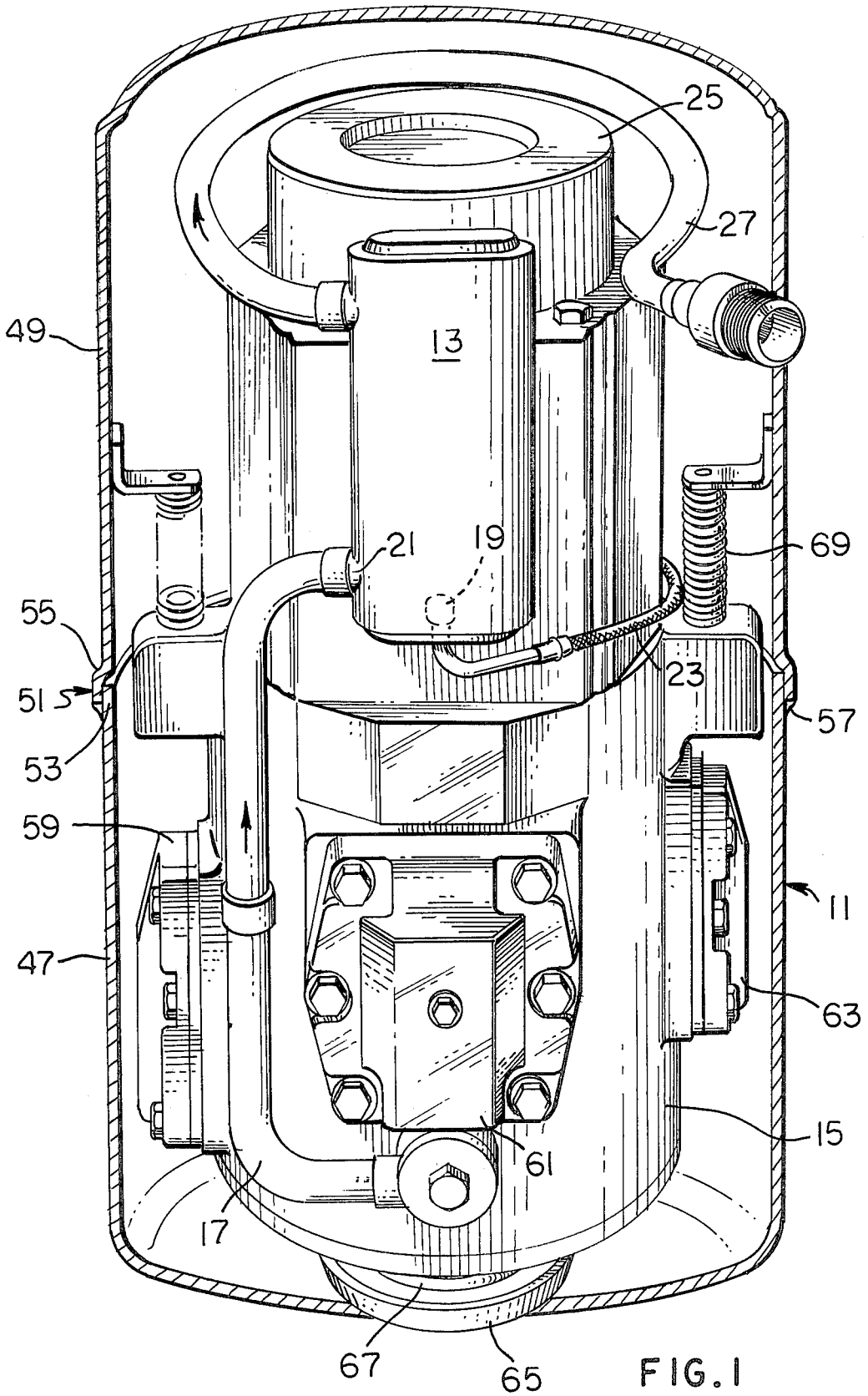
FIG. 1 is a perspective view, partially in section, of a hermetic motor compressor unit in one form of the invention.

Referring now to the drawings and in particular to FIG. 1, a hermetic motor-compressor unit 11 for an otherwise conventional refrigeration system having a compressor, an evaporator and a condenser in a series refrigerating circuit is illustrated. Such a hermetic unit for a refrigeration system may be used in a conventional home refrigerator, window or central air conditioning, vehicular air conditioning, heat pumps and the like. The hermetic unit contains a compressor discharge muffler 13 located within the hermetic unit at a location remote from the compressor 15, and the compressor 15 is coupled to the discharge muffler 13 by a conduit 17. A heat sensitive element 19 is supported on the discharge muffler 13 in good heat transfer relation with the compressed gas entering the discharge muffler 13 by way of the outlet 21 from the conduit 17 to provide an indication of the temperature of that compressed gas. The heat sensitive element 19 is connected by way of circuitry including the conductors 23 in controlling relation to the unit motor 25 for disabling that motor when the temperature of the compressed gas entering the discharge muffler through the opening 21 from the conduit 17 exceeds a maximum desired operating temperature.

Figure 3:
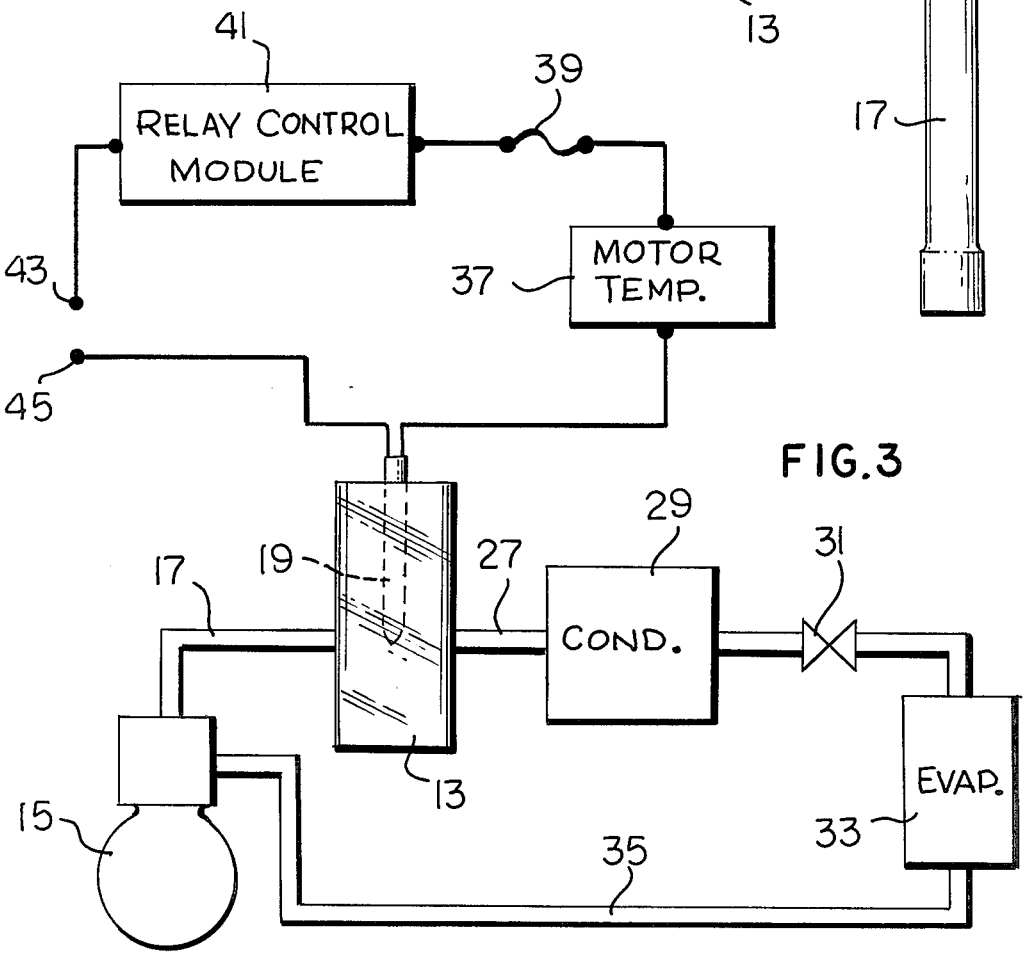
FIG. 3 illustrates in schematic form a refrigeration circuit and control circuit suitable for practicing the present invention.

The hermetic unit of FIG. 1 may be deployed in a system along the general lines illustrated in FIG. 3, wherein compressor 15 supplies discharge gas by way of conduit 17 to the discharge muffler 13 and thence by way of the outlet pipe 27, the discharge gas (refrigerant) is supplied to a condenser 29 to liquify that material, whereupon it passes through a restriction or expansion valve 31 to cool an evaporator 33 and be returned by way of return pipe 35 to the compressor 15. The temperature sensitive element 19 within the discharge muffler 13 is connected by conductors 23 to, for example, further circuitry such as a motor temperature protective element 37, as well as fusing or other protective features 39 to be connected in series between a motor relay 41 and a source of alternating current 43, 45. Thus, for example, the temperature sensitive element 19 may comprise a positive temperature coefficient thermistor and when the temperature thereof exceeds some predetermined value the resistance thereof becomes sufficiently great that the motor relay 41 does not receive adequate actuating current and therefore opens, disabling or interrupting motor operation. While the circuitry illustrated in FIG. 3 performs the desired function, commercially available solid state motor protection circuitry may be preferred in some installations.

The hermetic unit of FIG. 1 includes a first casing portion 47 and a second casing portion 49 which are joinable to form a sealed unit about an annular region 51 which is formed by a rim 53 on the one casing portion and a mating flange 55 on the other casing portion. Typically, these casing portions 47 and 49 are welded together about this annular region for example as at 57. Note that the annular region 51 and associated weld 57 defines generally a plane passing about midway through the hermetic unit with the compressor 15 disposed on one side of that plane while the motor 25, discharge muffler 13, heat sensor 19 and coupling circuitry 23 are all disposed on the other side of that plane with, of course, the motor drive shaft and conduit 17 piercing the plane of the annular region. Significantly, the electrical sensing and control circuitry is now all located somewhat remote from this annular region and no longer subject to heat damage during the welding operation. Thus, the first casing portion 47 encompasses primarily the compressor 15, while the second casing portion 49 encompasses primarily the motor 25, discharge muffler 13, heat sensitive element 19 and coupling circuitry including 23.

The compressor 15 may be of the type having a plurality of gas compressing cylinders, such as four, in the particular embodiment illustrated in FIG. 1, with three cylinder heads 59, 61 and 63 being visible in that Figure. Typically these cylinders would have their discharge ports connected together to form a discharge gas manifold within the compressor 15, with the conduit 17 being connected to that discharge gas manifold to supply the gas discharged from the compressor to the discharge muffler 13. In such a situation, the discharge gas manifold would function as a primary gas muffling chamber within the compressor and the compressor discharge muffler 13 would function as a second stage muffler, that second stage muffler being the muffler in which the heat sensitive element 19 is disposed.

The hermetic unit illustrated in FIG. 1 otherwise includes several somewhat conventional features, such as a spring mounting base 65 permanently affixed to the casing portion 47, which supports and confines a coil spring 67 for shock mounting the compressor 15 and motor 25. Further resilient mounting of the compressor unit is achieved by providing additional springs, such as 69. Other conventional techniques known in the hermetic compressor art may be employed in the unit as desired.

Figure 2:
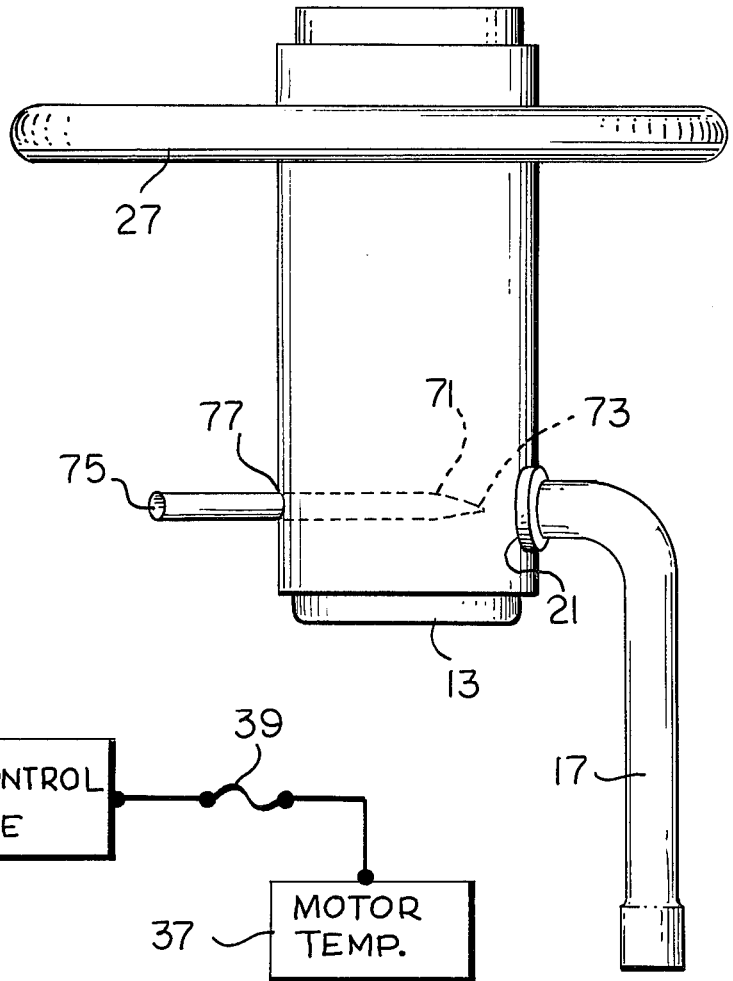
FIG. 2 is a side view of a discharge muffler suitable for use in the hermetic unit of FIG. 1, and illustrating an alternate placement of the heat sensitive element therein.

The precise technique for disposing the heat sensitive element, such as thermistor 19, in the discharge muffler 13 is best illustrated in FIG. 2. While the thermistor 19 entered the discharge muffler 13 from the bottom, as viewed in FIG. 1, this sensor may also be inserted from a side of the discharge muffler, as illustrated in FIG. 2. In FIG. 2 the discharge muffler 13 includes a thermistor receiving pocket or well 71, which extends inwardly from the discharge muffler outer surface, terminating in the vicinity of the entrance 21 of the conduit means 17. The well or pocket may comprise a tubular portion sealingly closed at one end 73 and open at the other end 75 for receiving the thermistor. The tubular portion may, for example, be welded about the annular joint 77 to insure good sealing of the interior of the discharge muffler 13, while allowing the locating of the thermistor within the well 71 in close proximity to opening 21 through which compressed gas enters the discharge muffler. A similarly formed pocket may enter the discharge muffler from the bottom as viewed in FIG. 1 to again place the sensor close to the entering compressed gas.

From the foregoing it is now apparent that a novel discharge gas temperature sensing arrangement has been disclosed meeting the objects and advantageous features set out hereinbefore as well as others and that modifications as to the precise configurations, shapes and details may be made by those having ordinary skill in the art without departing from the spirit of the invention or the scope thereof as set out by the claims which follow.

What is claimed is:

1. In a hermetic motor-compressor unit for a refrigeration system having a compressor, an evaporator and a condenser in a series refrigerating circuit, the improvement comprising:

a compressor discharge muffler within the hermetic unit located remote from the compressor and including a pocket extending from the outer surface of the muffler inwardly;

conduit means disposed within the hermetic unit forming a part of the refrigerating circuit and coupling hot gas from the compressor to the discharge muffler in the vicinity of the muffler pocket;

a heat sensitive element supported in the discharge muffler pocket and in good heat transfer relation with the compressed gas entering the discharge muffler to provide an indication of the temperature of that compressed gas; and circuitry coupling the heat sensitive element in controlling relation to the unit motor for disabling the motor when the temperature of the compressed gas entering the discharge muffler from the conduit means exceeds a maximum desired operating temperature.

2. The improvement of claim 1 wherein the heat sensitive element comprises a positive temperature coefficient thermistor.

3. The improvement of claim 2 wherein the pocket extends from the discharge muffler outer surface inwardly in the vicinity of the conduit means for locating the thermistor in close proximity to entering compressed gas while maintaining a gas seal between the thermistor and the muffler interior.

4. The improvement of claim 1 wherein the hermetic unit includes first and second casing portions joinable about an annular region formed by a rim on one casing portion and a mating flange on the other casing portion, the coupling circuitry disposed entirely on one side of the plane of the annular region.

5. The improvement of claim 4 wherein the casing portions are welded together about the annular region, the coupling circuitry being located within the unit sufficiently distant from the annular region to prevent heat damage to the circuitry during the welding operation.

6. The improvement of claim 5 wherein the first casing portion encompasses primarily the compressor and the second casing portion encompasses primarily the motor, discharge muffler, heat sensitive element and coupling circuitry.

7. The improvement of claim 6 wherein the hot gas conduit means passes through the plane of the annular region.

8. The improvement of claim 1 wherein the compressor includes a plurality of gas compressing cylinders having their respective discharge ports connected together to form a discharge gas manifold, the conduit means being connected between the discharge gas manifold and the discharge muffler.

9. The improvement of claim 8 wherein the discharge gas manifold functions as a preliminary gas muffling chamber within the compressor.

10. In a hermetic motor driven compressor unit including first and second casing portions sealingly joinable about an annular region formed by a rim on one casing portion and a mating flange on the other casing portion wherein the compressor includes a plurality of gas compressing cylinders having their respective discharge ports connected together to form a discharge gas manifold functioning as a muffler within the compressor, a discharge gas temperature sensing arrangement including:

a discharge muffler located apart from the compressor;

conduit means coupling the compressor discharge gas manifold to the discharge muffler;

a heat sensitive element disposed in a well extending inwardly from the discharge muffler surface with the heat sensitive element being in good heat transfer relation with the discharge gas entering the discharge muffler; and circuitry coupling the heat sensitive element in controlling relation to the compressor drive motor for interrupting motor operation when the temperature of the heat sensitive element exceeds a predetermined value, the coupling circuitry being disposed entirely on one side of the plane of the annular region joining the casing portions.

11. The temperature sensing arrangement of claim 10 wherein the heat sensitive element comprises a positive temperature coefficient thermistor.

12. The temperature sensing arrangement of claim 10 wherein the casing portions are welded together about the annular region, the coupling circuitry being located within the unit sufficiently distant from the annular region to prevent heat damage to the circuitry during the welding operation.

13. The temperature sensing arrangement of claim 12 wherein the first casing portion encompasses primarily the compressor and the second casing portion encompasses primarily the compressor drive motor, discharge muffler, heat sensitive element and coupling circuitry.

14. The temperature sensing arrangement of claim 13 wherein the hot gas conduit means passes through the plane of the annular region.

* * * * *